US007543470B2

(12) United States Patent
Taguchi et al.

(10) Patent No.: US 7,543,470 B2
(45) Date of Patent: Jun. 9, 2009

(54) ROLL STRAIGHTENER

(75) Inventors: Shinichi Taguchi, Fukishima (JP); Tetsuo Hosonuma, Niiza (JP)

(73) Assignee: Nihon Shinkan Co., Ltd., Saitama (JP)

( * ) Notice: Subject to any disclaimer, the term of this patent is extended or adjusted under 35 U.S.C. 154(b) by 47 days.

(21) Appl. No.: 11/520,625

(22) Filed: Sep. 14, 2006

(65) Prior Publication Data

US 2007/0062239 A1 Mar. 22, 2007

(30) Foreign Application Priority Data

Sep. 20, 2005 (JP) ..... 2005-271766

(51) Int. Cl.
*B21D 1/02* (2006.01)
*B21D 3/02* (2006.01)

(52) U.S. Cl. ..... 72/164; 72/160; 72/251

(58) Field of Classification Search ..... 72/164, 72/165, 160, 163, 226, 251, 232, 233; 140/147
See application file for complete search history.

(56) References Cited

U.S. PATENT DOCUMENTS 1,914,975 A * 6/1933 Nigro ..... 72/164
2,852,065 A * 9/1958 Peterson ..... 72/164
3,621,693 A * 11/1971 Adams ..... 72/164
3,765,210 A * 10/1973 Lemper ..... 72/164
4,594,872 A * 6/1986 Nordlof ..... 72/164
5,035,130 A * 7/1991 Del Fabro et al. ..... 72/162
5,617,754 A * 4/1997 Senft et al. ..... 72/165

FOREIGN PATENT DOCUMENTS

JP 8-24752 1/1996

* cited by examiner

*Primary Examiner*—Dana Ross
*Assistant Examiner*—Debra M Sullivan
(74) *Attorney, Agent, or Firm*—Wenderoth, Lind & Ponack, L.L.P.

(57) ABSTRACT

A roll straightener which is capable of being switched between a zigzag type and an opposed type is disclosed. The roll straightener has an odd-number of pairs of upper and lower rolls. A group of the lower rolls including the second lower roll from an insertion side of the straightener up to a lower roll located at a middle position are movable in vertical and transverse directions of the rolls, while the remaining upper rolls and lower rolls are movable in only the vertical direction.

6 Claims, 6 Drawing Sheets

ROLL STRAIGHTENER

BACKGROUND OF THE INVENTION

1. Field of the Invention

The present invention relates to a roll straightener for straightening a work.

2. Description of the Related Art

Heretofore, there has been known a roll straightener wherein plural pairs of rolls are arranged in upper and lower rows and a work is passed between upper and lower rolls so as to be straightened. There is a case where the work is passed without rotation and a case where it is passed with rotation. Straighteners are broadly classified into a zigzag type and an opposed type, depending on the layout of rolls.

First, a zigzag type roll straightener will be described with reference to FIG. 5. For example, the zigzag type roll straightener is provided with seven upper rolls 51, 52, 53, 54, 55, 56, 57 and seven lower rolls 61, 62, 63, 64, 65, 66, 67. Upper roll 51 and lower roll 61 are aligned vertically with each other at an inlet side where a work 10 such as a pipe is introduced. At an outlet side, three pairs of upper rolls 55, 56, 57 and lower rolls 65, 66, 67 are disposed so that each pair of rolls are aligned vertically with each other. The three upper rolls 55, 56 and 57 are set at the same height and, likewise, the three lower rolls 65, 66 and 67 are set at the same height. Second to fourth upper rolls 52, 53, 54 and lower rolls 62, 63, 64, which are close to the inlet side (the rolls located closest to the inlet side are assumed to be first rolls), are disposed in a zigzag fashion (the upper and lower rolls assume alternate positions). The second to fourth upper rolls 52, 53 and 54 are positioned a certain fraction of a millimeter below the other upper rolls 51, 55, 56 and 57. Likewise, the second to fourth lower rolls 62, 63 and 64 are positioned a certain fraction of a millimeter above the other lower rolls 61, 65, 66 and 67.

The work 10 is moved from between the inlet-side (first) upper roll 51 and lower roll 61 toward the outlet-side (seventh) upper roll 57 and lower roll 67. After passing the zigzag upper rolls 52, 53, 54 and lower rolls 62, 63, 64, the work passes three pair of respectively vertically aligned upper rolls 55, 56, 57 and lower rolls 65, 66, 67, whereby the work 10 is straightened. This zigzag type roll straightener is advantageous in that the roundness is good, but is markedly disadvantageous in that the strain is conspicuous.

Next, an opposed type roll straightener is shown in FIG. 6. The opposed type roll straightener is disclosed in Japanese Patent Laid-Open Publication No. H08 (1996)-24752 and is provided with, for example, seven upper rolls 71, 72, 73, 74, 75, 76, 77 and seven lower rolls 81, 82, 83, 84, 85, 86, 87, which pairs are each aligned vertically. The seven pairs of upper and lower rolls are disposed in a chevron shape that symmetric about a central pair of upper and lower rolls forming a vertex. This opposed type roll straightener is advantageous in that the strain is less conspicuous, but is disadvantageous in that the roundness is poor.

Thus, the zigzag type and the opposed type each have an advantage and a disadvantage contrary to each other with respect to roundness and strain. Therefore, it has been necessary for a concerned trader to provide two types of machines, i.e., zigzag type and opposed type straighteners, according to the work to be straightened. Consequently, in addition to cost increases, it has been necessary to ensure a correspondingly increased space within the factory concerned.

On the other hand, if all the pairs of upper and lower rolls are made movable vertically and transversely, it may be possible for one roll straightener to serve as both a zigzag type and an opposed type straightener. In such a roll straightener it is not necessary to provide two machines of zigzag type and opposed type, so that the space for a single machine suffices in the factory concerned.

In the roll straightener wherein all the pairs of upper and lower rolls (a total of fourteen rolls) are movable vertically and transversely, the cost can be reduced in comparison with the case where two types of roll straighteners are provided. However, the cost is not reduced much because a lot of means are required for such vertical and transverse movements. Moreover, for switching between the zigzag type and the opposed type, it is necessary to change the positions of the total of fourteen rolls in the vertical and transverse directions. Thus, considerable time is required, and the production efficiency is poor.

BRIEF DESCRIPTION OF THE INVENTION

It is an object of the present invention to provide a roll straightener serving as both zigzag type and opposed type straightener, which is easy to switch from one to the other type and capable of being manufactured at low cost.

In one aspect of the present invention there is provided a roll straightener having an odd-number of pairs of upper rolls and lower rolls, wherein a work is passed between the upper rolls and the lower rolls so as to be straightened. The straightener is characterized in that on one of the upper rolls side and the lower rolls side a plurality of rolls from the second roll counted from a work insertion side up to an odd-numbered roll located at a middle position are movable in both vertical and transverse directions of the rolls. Further, the upper rolls and lower rolls, exclusive of the plural rolls movable in both vertical and transverse directions, an inlet-side upper roll and lower roll, and an outlet-side upper roll and lower roll, are movable in only the vertical direction. In another aspect of the present invention, the inlet-side upper roll and lower roll and the outlet-side upper roll and lower roll are movable in only the vertical direction. In a further aspect of the present invention, the plural rolls movable in both vertical and transverse directions have respective rotating shafts, and there is a support member formed with elongated holes. The holes support the plural rotating shafts vertically movably vertically moveable manner when the shafts are inserted therein.

Of all the upper and lower rolls, the only rolls movable in both vertical and transverse directions are the rolls from the second roll counted from the work insertion side up to an odd-numbered roll located at a middle position, which are located on either the upper rolls side or the lower rolls side. The other rolls, exclusive of inlet-side and outlet-side rolls, are movable in only the vertical direction, whereby a change can be made in a short time between the zigzag type and the opposed type and, thus, the roll straightener can be manufactured at low cost. Further, the shafts of the plural rolls movable in both vertical and transverse directions are supported by a support means which can be moved to allow the plural rolls to be easily moved laterally, without the need to adjust each of them individually.

DETAILED DESCRIPTION OF THE INVENTION

The present invention will be described with reference to the accompanying drawings.

Figure 1:
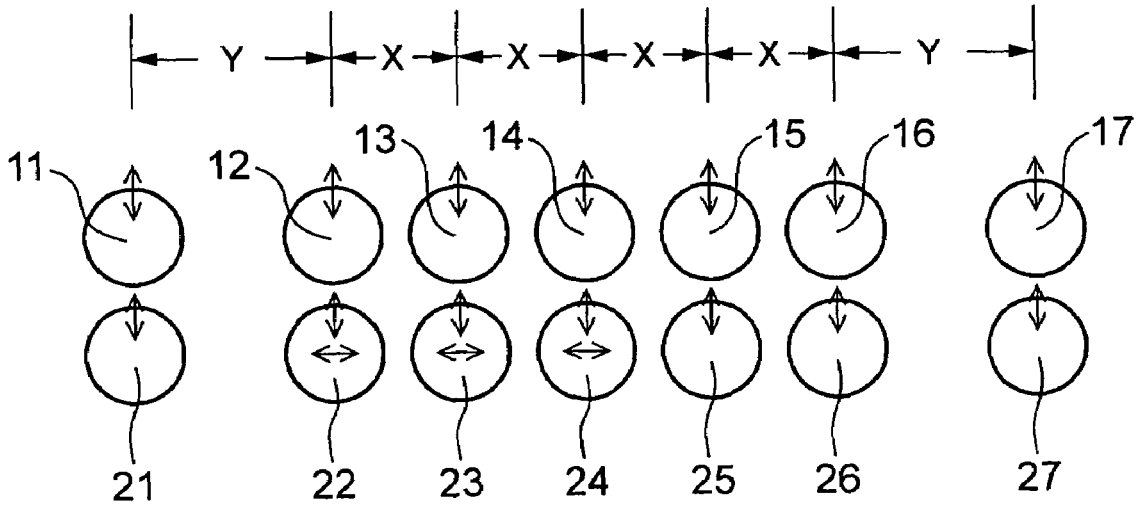
FIG. 1 is a schematic construction diagram of a roll straightener according to the present invention.

FIG. 1 is a schematic construction diagram of a roll straightener according to the present invention. In the present invention five or more odd-numbered pairs of upper and lower rolls are used. In this embodiment seven pairs of upper and lower rolls are used. More specifically, there are used seven upper rolls 11, 12, 13, 14, 15, 16, 17 and seven lower rolls 21, 22, 23, 24, 25, 26, 27. The upper roll 11 and the lower roll 21 are disposed on an inlet side (first position) for a work 10, while the upper roll 17 and the lower roll 27 are disposed on an outlet side (seventh position) for the work 10. In the present invention there is a rotating means for rotating the seven upper rolls 11, 12, 13, 14, 15, 16 and 17; a moving means for moving the rotating means; a rotating means for rotating the seven lower rolls 21, 22, 23, 24, 25, 26 and 27; and a moving means for moving the rotating means. Since these rotating means and moving means are known structures, their illustrations are omitted.

The seven upper rolls 11, 12, 13, 14, 15, 16 and 17 are movable in only the vertical direction and not movable in the transverse direction. The inlet-side upper roll 11 and the outlet-side upper roll 17 may be set so as not to move in the vertical direction (that is, not movable in both the vertical and transverse directions). The five upper rolls 12, 13, 14, 15 and 16 are arranged at equal intervals of X. The spacing between the inlet-side upper roll 11 and the upper roll 12 adjacent thereto is set at Y, and the spacing between the outlet-side upper roll 17 and the upper roll 16 adjacent thereto is also set at Y. The spacing Y is set at a distance longer than the spacing X.

Of the seven lower rolls, the lower rolls 21, 25, 26 and 27 are vertically aligned with the upper rolls 11, 15, 16 and 17, respectively. The lower rolls 21, 25, 26 and 27 are movable in only the vertical direction and not movable in the transverse direction. The inlet-side lower roll 21 and the outlet-side lower roll 27 may be set so as not to move in the vertical direction (that is, not movable in the vertical and transverse directions).

Of the seven lower rolls, the remaining three lower rolls 22, 23 and 24 are set so as to be movable in both vertical and transverse directions. That is, of the seven lower rolls, the second lower roll 22 up to the lower roll 24 which is located at the middle position are set so as to be movable in both vertical and transverse directions. As clearly illustrated by the horizontal arrows in FIG. 1, the "transverse direction" as used herein means a side-to-side direction along the row of rolls (e.g., substantially parallel to a direction of movement of the workpiece passing between the rows of rolls). According to the embodiment illustrated in FIG. 1, which includes seven lower rolls, the three lower rolls 22, 23 and 24 are movable in both vertical and transverse directions. However, in case of five lower rolls, two lower rolls from the second to the middle lower roll are movable in both vertical and transverse directions, and in case of nine lower rolls, four lower rolls from the second to the middle lower roll are movable in both vertical and transverse directions.

Next, a description will be given about the case where the roll straightener according to the present invention is switched to an opposed type roll straightener. Of the seven pairs of upper and lower rolls, the upper rolls 11, 15, 16, 17 and the lower rolls 21, 25, 26, 27 are vertically aligned, respectively, and are all set so as not to move in the transverse direction. Of the remaining three pairs, the upper rolls 12, 13 and 14 are set so as not to move in the transverse direction, but since the lower rolls 22, 23 and 24 are movable in the transverse direction, the lower rolls 22, 23 and 24 are moved in the transverse direction into vertical alignment with the upper rolls 12, 13 and 14, respectively. As a result, all of the seven pairs of upper rolls 11, 12, 13, 14, 15, 16, 17 and lower rolls 21, 22, 23, 24, 25, 26, 27 are vertically aligned, respectively.

Figure 2:
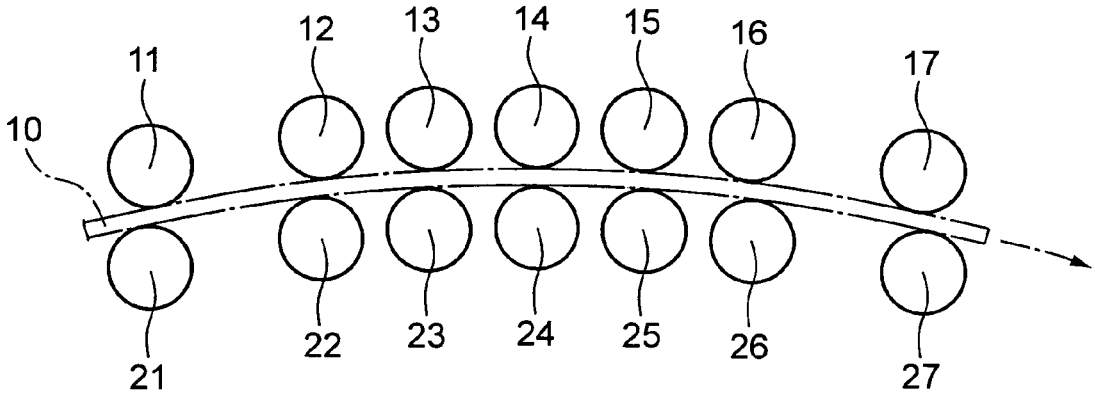
FIG. 2 is a schematic construction diagram showing a state in which the roll straightener according to the present invention has been switched to an opposed type roll straightener.

Thereafter, the inlet-side upper roll 11 and the outlet-side upper roll 17 are set at the same height, and the heights of the five upper rolls 12, 13, 14, 15 and 16, located between the upper rolls 11 and 17, are set in a chevron shape which is symmetric about a middle portion that is higher than the other portion (FIG. 2). The middle upper roll 14 is located at the highest position, usually about several millimeters higher than the upper rolls 11 and 17 located at both ends. Likewise, the inlet-side lower roll 21 and the outlet-side lower roll 27 are set at the same height, and the heights of the five lower rolls 22, 23, 24, 25 and 26 located between the lower rolls 21 and 27 are set in a chevron shape symmetric right and left with a middle portion being higher than the other portions (FIG. 2). The height of the middle lower roll 24 located at the highest position is usually set about several millimeters higher than the lower rolls, 21 and 27, located at both ends. The spacing between each pair of upper and lower rolls vertically aligned with each other is set so as to permit insertion therethrough of the work 10. By thus moving the upper and lower rolls it is possible to constitute an opposed type roll straightener. The work 10 can be straightened by passing it between the upper rolls 11, 12, 13, 14, 15, 16, 17 and the lower rolls 21, 22, 23, 24, 25, 26, 27.

Next, a description will be given about switching the roll straightener according to the present invention from the opposed type to a zigzag type. In an initial state, all of the seven pairs of upper rolls 11, 12, 13, 14, 15, 16, 17 and lower rolls 21, 22, 23, 24, 25, 26, 27 are vertically aligned, respectively; all the upper rolls are at the same height and so are all the lower rolls (FIG. 1). From the state of FIG. 1, the three transversely movable lower rolls 22, 23 and 24 are moved toward the inlet-side lower roll 21 (leftward in the figure) (FIG. 3) while being held at equal spacing X.

Figure 3:
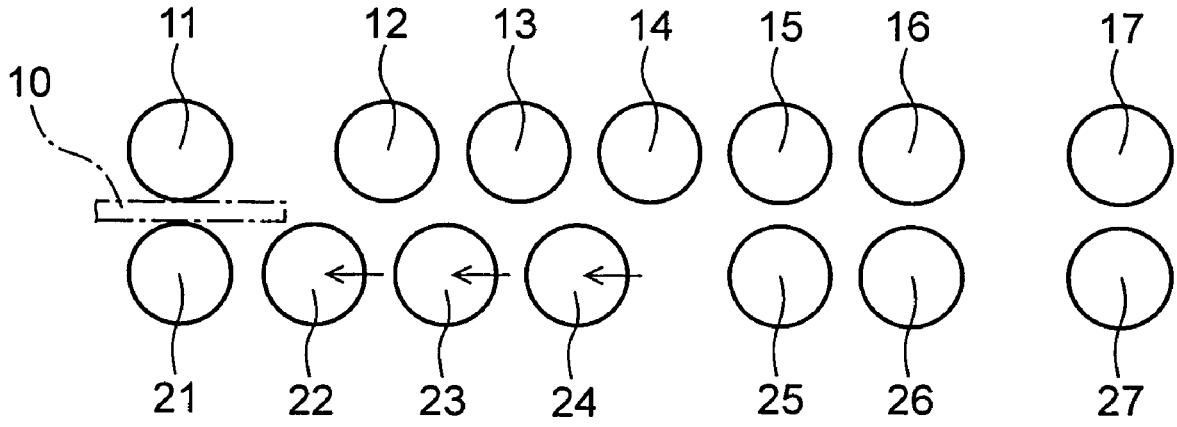
FIG. 3 is an enlarged diagram of a principal portion, showing a state in which some rolls in the roll straightener according to the present invention have been moved from the state of FIG. 2.

In the state of FIG. 3 in which the three lower rolls 22, 23 and 24 have been moved toward the inlet-side lower roll 21, the lower roll 22, in the horizontal direction, is positioned between the upper rolls 11 and 12, the lower roll 23 is positioned between the upper rolls 12 and 13, and the lower roll 24 is positioned between the upper rolls 13 and 14. Thereafter, the lower rolls 22, 23 and 24 are moved upward by a predetermined height, while the upper rolls 12, 13 and 14 are moved downward by a predetermined height. The predetermined height of the lower rolls 22, 23, 24 and that of the upper rolls 12, 13, 14 is about several millimeters below the decimal. By moving the lower rolls 22, 23, 24 and the upper rolls 12, 13, 14 vertically from the state of FIG. 3 it is possible to constitute a zigzag type roll straightener. The work 10 can be straightened by passing it between the upper rolls 11, 12, 13, 14, 15, 16, 17 and the lower rolls 21, 22, 23, 24, 25, 26, 27.

Thus, in the present invention, all of the upper and lower rolls are moved vertically (as the case may be the inlet- and outlet-side upper and lower rolls are not moved vertically) so that the invention can be applied to any one of both opposed type and zigzag type roll straighteners, but it is only the three lower rolls 22, 23 and 24 that are moved horizontally. In this way both opposed type and zigzag type roll straighteners can be fabricated while limiting the number of rolls which are moved horizontally to a small number, whereby the manufacturing cost can be reduced and the area of roll straightener installation in the factory concerned can be diminished.

Figure 4:
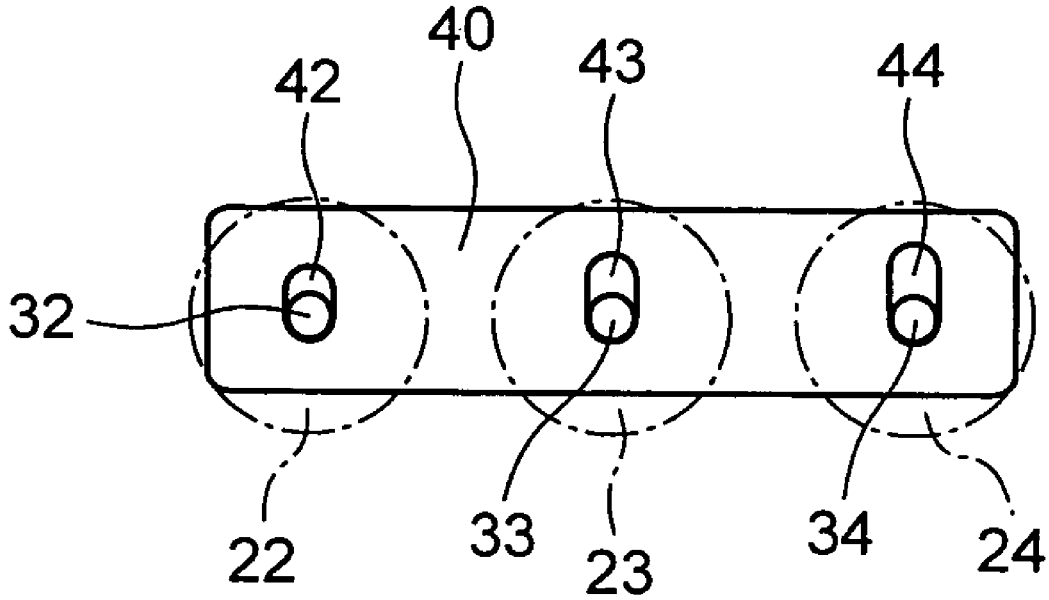
FIG. 4 is a schematic construction diagram showing a state in which the roll straightener according to the present invention has been switched to a zigzag type roll straightener.
Figure 5:
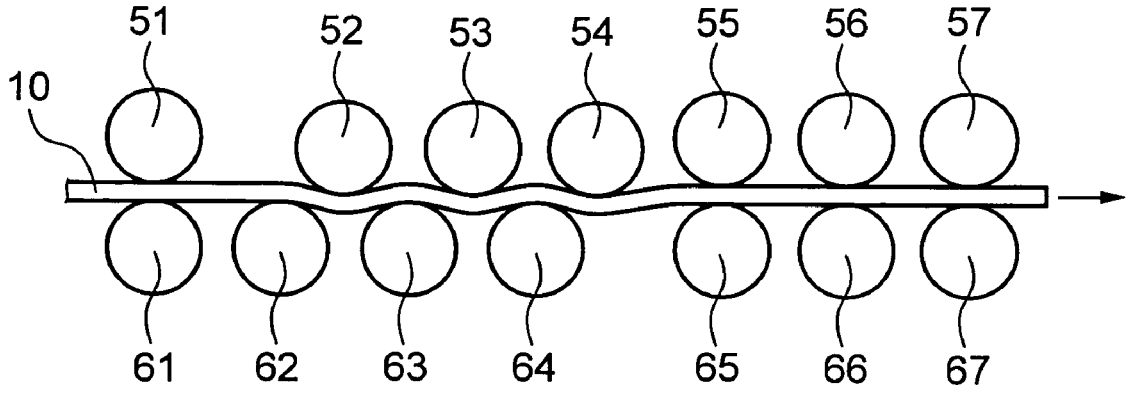
FIG. 5 is a schematic construction diagram of a conventional, known zigzag type roll straightener.
Figure 6:
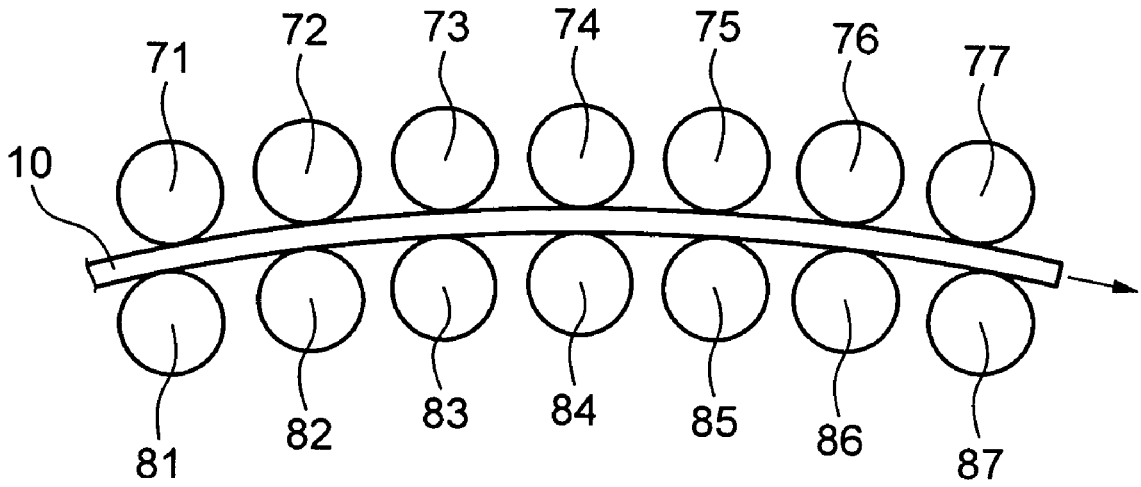
FIG. 6 is a schematic construction diagram of a conventional, known opposed type roll straightener.

Next, with reference to FIG. 4, a description will be given about the structure of moving the lower rolls 22, 23 and 24 all together in the transverse direction. The lower rolls 22, 23 and 24 have respective rotating shafts 32, 33 and 34, which are inserted respectively into holes 42, 43 and 44 formed in a support member 40. The horizontal spacing between the holes 42 and 43 and the horizontal spacing between the holes 43 and 44 are each set at X. The holes 42, 43 and 44 are formed vertically long so that the rotating shafts 32, 33 and 34 can move vertically. Further, a moving means for moving a rotating means (not shown) for the lower rolls 22, 23 and 24 is fixed to the support member 40. In case of switching between the opposed type and the zigzag type, the lower rolls 22, 23 and 24 can be moved transversely by only moving the support member 40 with use of moving means (not shown) without the need of making a positional adjustment in the transverse direction of the lower rolls 22, 23 and 24. In this way the opposed type and the zigzag type can be easily switched from one to the other. The support member 40 is used in the example, but it is not always necessary to use the support member 40.

Although in the above embodiment the lower rolls 22, 23 and 24 are moved in the transverse direction, the upper rolls 12, 13 and 14, instead of the lower rolls 22, 23 and 24, may be moved in the transverse direction. Further, although in the above embodiment seven pair of upper and lower rolls are used, there may be five, nine, or more odd-numbered pairs of upper and lower rolls. The reason why odd-numbered pairs are used is that one pair located on the middle position is to be made the vertex in the opposed type.

What is claimed is:

1. A roll straightener comprising a plurality of rolls including an odd number of at least five upper rolls arranged to form an upper row, and an odd number of at least five lower rolls arranged to form a lower row, said upper rolls and said lower rolls being arranged to allow a workpiece passed between said upper row of upper rolls and said lower row of lower rolls to be straightened, wherein:

a first group of said rolls is moveable in both a vertical and in a transverse direction of said rolls, said first group of rolls being located on said upper row or said lower row, and including at least an innermost roll located at a middle position of said upper row or said lower row, and a roll adjacent to said innermost roll and closest to a workpiece insertion side of said roll straightener;

a second group of said rolls, which is exclusive of each of said first group of rolls, an inlet-side upper roll, an inlet-side lower roll, an outlet-side upper roll, and an outlet-side lower roll, is movable only in the vertical direction, so as to allow said roll straightener to be adjusted between an opposed arrangement, in which said upper rolls and said lower rolls are vertically aligned with and oppose each other, and a zig-zag arrangement, in which at least one of said upper rolls is offset from one of said lower rolls.

2. The roll straightener according to claim 1, wherein said inlet-side upper roll, said inlet-side lower roll, said outlet-side upper roll, and said outlet-side lower roll are movable in only the vertical direction.

3. The roll straightener according to claim 1, wherein said first group of said rolls have respective rotating shafts, said roll straightener further comprising a support member having elongated holes for receiving and supporting said rotating shafts in a vertically movable manner.

4. The roll straightener according to claim 1, wherein there is an identical number of upper rolls and lower rolls such that there are at least five pairs of upper rolls and lower rolls.

5. The roll straightener according to claim 1, wherein there is an identical number of upper rolls and lower rolls.

6. The roll straightener according to claim 1, wherein said first group of rolls located on said upper row or said lower row includes said innermost roll, a second roll from the workpiece insertion side of said roll straightener, and any of said upper or lower rolls between said innermost roll and said second roll from the workpiece insertion side.

* * * * *